US008331816B2

(12) United States Patent
Sheflin et al.

(10) Patent No.: US 8,331,816 B2
(45) Date of Patent: Dec. 11, 2012

(54) PRINTER CONTROL SYSTEM TO MINIMIZE TWO-DIMENSIONAL IMAGE QUALITY DEFECTS

(75) Inventors: Joseph C. Sheflin, Macedon, NY (US); Jack T. Lestrange, Macedon, NY (US); Martin Edward Hoover, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 714 days.

(21) Appl. No.: 12/177,287

(22) Filed: Jul. 22, 2008

(65) Prior Publication Data

US 2010/0021189 A1 Jan. 28, 2010

(51) Int. Cl.
*G03G 15/10* (2006.01)

(52) U.S. Cl. ..... 399/60

(58) Field of Classification Search ..... 399/49, 399/58, 60

See application file for complete search history.

(56) References Cited

U.S. PATENT DOCUMENTS

| | | | | |
|---|---|---|---|---|
| 5,278,589 | A | 1/1994 | Wong | |
| 5,365,074 | A | 11/1994 | Genovese | |
| 5,436,705 | A * | 7/1995 | Raj | 399/59 |
| 6,842,590 | B2 | 1/2005 | Dalal et al. | |
| 6,904,255 | B2 | 6/2005 | Kera et al. | |
| 6,975,949 | B2 | 12/2005 | Mestha et al. | |
| 7,013,094 | B2 | 3/2006 | Dalal et al. | |
| 7,177,585 | B2 | 2/2007 | Matsuzaka et al. | |
| 7,236,711 | B2 | 6/2007 | Burry et al. | |
| 7,313,337 | B2 | 12/2007 | Burry et al. | |
| 2004/0008245 | A1 * | 1/2004 | Hirai et al. | 347/129 |
| 2005/0036705 | A1 | 2/2005 | Viassolo et al. | |
| 2006/0109487 | A1 | 5/2006 | Klassen | |
| 2007/0003109 | A1 | 1/2007 | Wu et al. | |
| 2007/0092274 | A1 * | 4/2007 | Ramesh et al. | 399/49 |
| 2007/0201097 | A1 | 8/2007 | Anderson et al. | |

OTHER PUBLICATIONS

Fahlcrantz, Carl-Magnus et al., "Evaluating Colour Print Mottle", 33rd International Research Conference of iarigai, Leipzig, Germand, Sep. 10-13, 2006, 15 pp.

Canet, Christine et al., "Influence of mottle on color reproduction," 28th Research Conference of iarigai, Montreal, Canada, Oct. 9-12, 2001, 10 pp.

Fahlcrantz, Carl-Magnus et al., "A Comparison of Different Print Mottle Evaluation Models," 56th Annual Technical Conference of the Technical Association of the Graphic Arts, TAGA 2004, 15 pp.

* cited by examiner

*Primary Examiner* — David Gray
*Assistant Examiner* — Gregory H Curran
(74) *Attorney, Agent, or Firm* — Pillsbury Winthrop Shaw Pittman, LLP

(57) ABSTRACT

An image printing system configured to minimize two-dimensional image quality non-uniformities on printed documents is provided. The image printing system includes a marking engine, a linear array sensor, an image analyzer, and a controller. The marking engine is constructed to print toner images on an image bearing surface moving in a process direction. The marking engine comprising of a toner development system. The linear array sensor is adjacent the image bearing surface and is extending in a cross-process direction. The linear array sensor is configured to scan the toner image on the image bearing surface. The image analyzer is configured to detect a two-dimensional non-uniformity in the toner image. The controller is configured to control at least one control parameter of the toner development system based on the two-dimensional image quality non-uniformity in the toner image that is detected by the linear array sensor.

10 Claims, 8 Drawing Sheets

PRINTER CONTROL SYSTEM TO MINIMIZE TWO-DIMENSIONAL IMAGE QUALITY DEFECTS

BACKGROUND

1. Field

The present disclosure relates to a method and a system that is configured to minimize two-dimensional image quality non-uniformities on printed documents.

2. Description of Related Art

Two-dimensional image quality non-uniformities affect the performance of an image printing system. Two such two-dimensional image quality non-uniformities that are known to originate in the image printing system include noise mid-frequency (often referred to as "mottle") and reload.

Many image printing devices use donor rolls to transfer toner to an image bearing surface for developing an image thereon. These donor rolls generally accumulate toner as they rotate. After transferring toner to an image or a portion of an image, the donor roll "reloads" with toner as it rotates. Depending on the previous image content or portion of an image being developed, the donor roll may not be able to accumulate a sufficient level of toner to properly develop the current image. This inability to fully reload the donor roll causes the later drawn image or portion of an image to have an area lighter than it should be.

This failure to complete reloading of the donor roll in one revolution results in an image quality non-uniformity called reload error. The reload error is referred to as a depletion of toner on the donor roll of a toner development system. The reload error can occur in any device using a donor roll.

For example, the reload defect occurs where the structure of an image from one revolution of the donor roll is visible in the image printed by the next successive donor roll revolution, a phenomenon known in the art as "ghosting". At locations on the donor roll where previous images were located, the level of toner may be lower than desired. This causes an undesirable lightening of parts of an image, depending on what was imaged earlier. One area where reload error may have a significant effect is in color calibration systems.

Irregular two-dimensional variations caused by various sources of noise in the printing process can form graininess or mottle in the image. For example, in an electrophotographic system, graininess and mottle are usually found in and caused by the development subsystem, and mottle can be enhanced by the incomplete transfer of toner to substrate. The mottle is often characterized by the non-uniform printing or coloring of an image. Both of these are two-dimensional variations in gray level, which take the appearance of dots or small irregular shapes. Graininess is similar to mottle but the variations are smaller in size.

These two-dimensional image quality non-uniformities (e.g., mid-frequency image noise (mottle) and reload) are known to originate in the toner development system of the image printing system and, in the case of mottle, can be magnified by subsequent xerographic sub-systems. The degradation in mottle and reload performance often results in unsatisfied customers, and unscheduled service actions (i.e. replacement of the developer material) that are both costly and unproductive to the manufacturer/service provider and customers alike.

Other than the magnetic roll bias, all other toner development system parameters (i.e. donor to magnetic roll AC voltage, toner concentration, magnetic roll speed, etc.) generally have fixed values in the prior systems, which are determined through optimization testing across various noise inputs.

Through this testing, performance is often traded off against sub-system latitude, shortchanging maximum achievable image quality performance.

U.S. Pat. No. 7,236,711, herein incorporated by reference, discloses a method for identifying specific transfer defects in a xerographic print engine using residual mass. These specific defects may include mottle, graininess, streaks, or point deletions. A full width array is used as a residual mass sensor. Upon identification, a closed-loop control of the transfer process is performed taking into account the identified defect types, as well as their magnitudes, to correct or compensate for the defects. This patent, however, senses the residual mass remaining on a photoreceptor, or other substrate, surface after transfer process (e.g., the transfer of toner to a media) in a Xerographic process. In contrast, the present disclosure scans the developed toner images on an image bearing surface to detect the two-dimensional image quality non-uniformities of the toner image on the image bearing surface.

Specifically, the present disclosure proposes a method and a system to sense and subsequently minimize toner development system related two-dimensional image quality non-uniformities on printed documents through closed loop control of the appropriate toner development system parameters. The closed loop control of the appropriate toner development system parameters will ensure maximum two-dimensional image quality performance (e.g., optimal mottle and reload performance) consistency.

SUMMARY

In an embodiment, an image printing system configured to minimize two-dimensional image quality non-uniformities on printed documents is provided. The image printing system includes a marking engine, a linear array sensor, an image analyzer, and a controller. The marking engine is constructed to print toner images on an image bearing surface moving in a process direction. The marking engine comprising of a toner development system. The linear array sensor is adjacent to the image bearing surface and is extending in a cross-process direction. The linear array sensor is configured to scan the toner image on the image bearing surface. The image analyzer is configured to detect a two-dimensional non-uniformity in the toner image. The controller is configured to control at least one control parameter of the toner development system based on the two-dimensional image quality non-uniformity in the toner image that is detected by the image analyzer.

In another embodiment, a method for minimizing two-dimensional image quality non-uniformities on printed documents is provided. The method includes printing toner images on an image bearing surface moving in a process direction; scanning the toner image on the image bearing surface using a linear array sensor, wherein the linear array sensor is extending in a cross-process direction and is adjacent the image bearing surface; detecting a two-dimensional non-uniformity in the toner image using an image analyzer; and controlling at least one control parameter of a toner development system based on the two-dimensional image quality non-uniformity in the toner image that is detected by the image analyzer.

Other aspects, features, and advantages will become apparent from the following detailed description, and the accompanying drawings.

BRIEF DESCRIPTION OF THE DRAWINGS

Various embodiments will now be disclosed, by way of example only, with reference to the accompanying schematic drawings in which corresponding reference symbols indicate corresponding parts, in which.

DETAILED DESCRIPTION

U.S. Pat. Nos. 6,842,590, 7,013,094, and 7,313,337; and U.S. Patent Application Publication No. 2006/0109487; 2007/0003109; and 2007/0201097, herein incorporated by reference, are examples of prior art approaches.

The present disclosure proposes an image printing system that scans (e.g., using a linear array sensor (e.g., a full width array (FWA))) a toner image on an image bearing surface and then subsequently minimizes toner development system related two-dimensional image quality non-uniformities through closed loop control of appropriate toner development system parameters. For example, as discussed above, different forms of two-dimensional image quality non-uniformities that can be detected and minimized are noise mid-frequency (mottle), graininess and reload. However, it is contemplated that the present disclosure is not limited to these forms of two-dimensional image quality non-uniformities but may be extended to any other form of two-dimensional image quality non-uniformities. In one embodiment, the closed loop control of the appropriate toner development system parameters (e.g., toner concentration, magnetic roll speed, donor to magnetic roll AC voltage, donor to magnetic roll DC voltage, etc.,) ensure that optimal mottle and reload performance are maintained.

Figure 1:
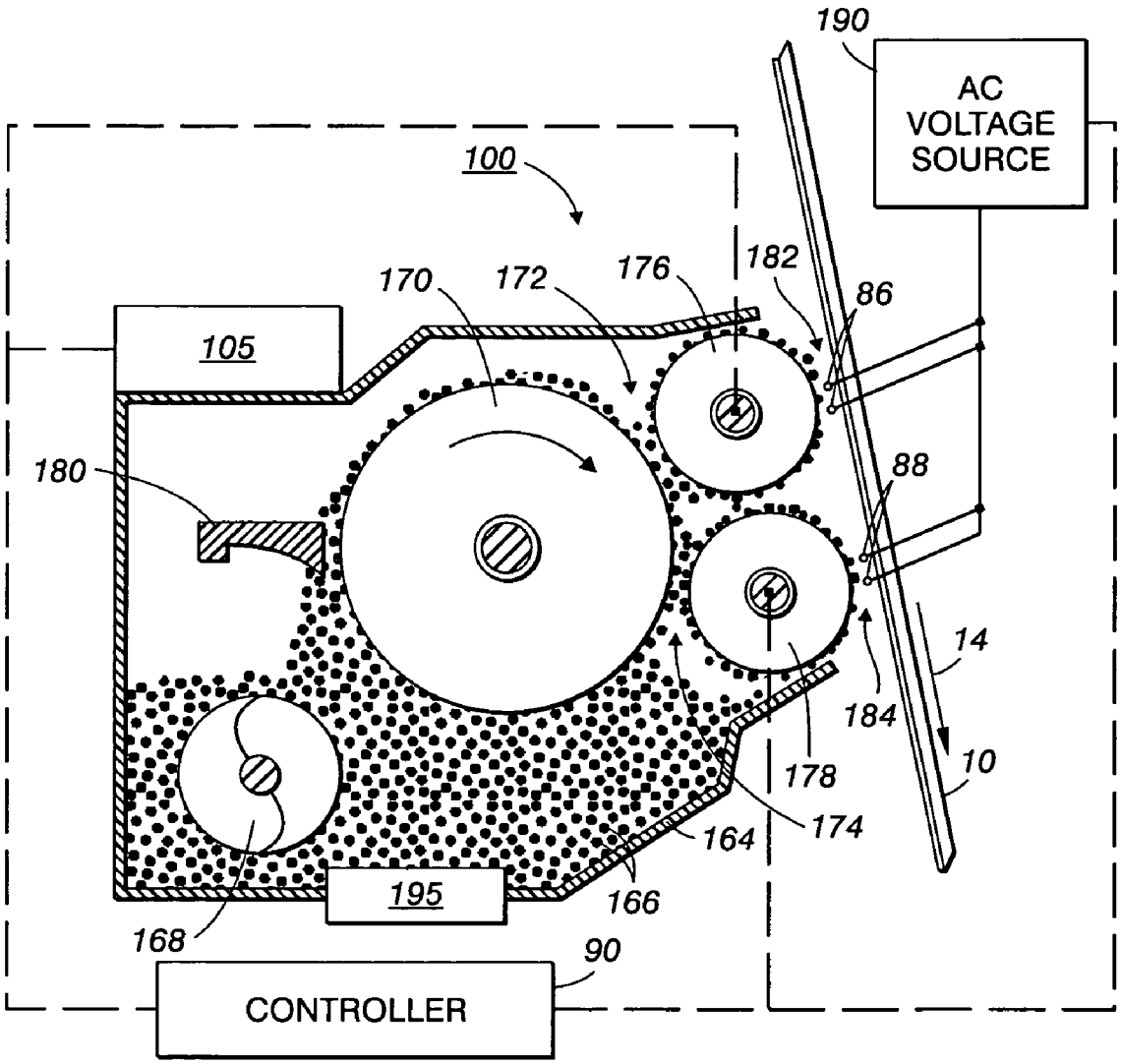
FIG. 1 shows a schematic view of a toner development system.

Because the two-dimensional image quality non-uniformities (e.g., noise mid-frequency (mottle) and reload) that are discussed here originate in the toner development system of the image printing system, it will be useful to understand the construction and the operation of the toner development system 100. Referring now to FIG. 1, the toner development system 100 includes a reservoir 164 containing developer material 166. The developer material 166 may be either of the one component or two component type; that is, it comprises carrier granules and toner particles. The reservoir 164 includes augers 168, which are rotatably-mounted in the reservoir chamber. The augers 168 serve to transport and to agitate the material within the reservoir 164 and encourage the toner particles to charge and adhere triboelectrically to the carrier granules. In one embodiment, a magnetic brush roll 170 transports developer material 166 from the reservoir to loading nips 172 and 174 of donor rolls 176 and 178. Magnetic brush rolls are well known, so the construction of roll 170 is not described in great detail. Briefly, the roll 170 includes a rotatable tubular housing within which is located a stationary magnetic cylinder having a plurality of magnetic poles impressed around its surface. The carrier granules of the developer material 166 are magnetic and, as the tubular housing of the roll 170 rotates, the granules (with toner particles adhering triboelectrically thereto) are attracted to the roll 170 and are conveyed to the donor roll loading nips 172 and 174. A metering blade 180 removes excess developer material from the magnetic brush roll 170 and ensures an even depth of coverage with developer material 166 before arrival at the first donor roll loading nip 172.

At each of the donor roll loading nips 172 and 174, toner particles are transferred from the magnetic brush roll 170 to the respective donor roll 176 and 178. The carrier granules and any toner particles that remain on the magnetic brush roll 170 are returned to the reservoir 164 as the magnetic brush continues to rotate. The relative amounts of toner transferred from the magnetic roll 170 to the donor rolls 176 and 178 can be adjusted, for example, by applying different bias voltages to the donor rolls; by adjusting the magnetic to donor roll spacing; by adjusting the strength and shape of the magnetic field at the loading nips; and/or by adjusting the speeds of the donor rolls.

Each donor roll 176 or 178 transports the toner to a respective development zone 182 and 184 through which the image bearing surface 10 passes. At each of the development zones 182 and 184, toner is transferred from the respective donor roll 176 and 178 to the latent image on the image bearing surface 10 to form a toner image on the latter. Various methods of achieving an adequate transfer of toner from a donor roll to a latent image on an image bearing surface are known and any of those may be employed at the development zones 182 and 184. Transfer of toner from the magnetic brush roll 170 to the donor rolls 176 and 178 can be encouraged by, for example, the application of a suitable D.C. electrical bias to the magnetic brush and/or donor rolls. The D.C. bias (for example, approximately 70 V applied to the magnetic roll) establishes an electrostatic field between the donor rolls 176 and 178 and magnetic brush roll 170 that causes toner particles to be attracted to the donor roll from the carrier granules on the magnetic roll.

In the toner development system 100 of FIG. 1, each of the development zones 182 and 184 is shown as having a pair of electrode wires 86 and 88 disposed in the space between each donor roll 176 and 178 and image bearing surface 10. The electrode wires may be made from thin (for example, 50 to 100 micron diameter) stainless steel wires closely spaced from the respective donor roll. The wires are self-spaced from the donor rolls by the thickness of the toner on the donor rolls and may be within the range from about 5 micron to about 20 micron (typically about 10 micron) or the thickness of the toner layer on the donor roll.

For each of the donor rolls 176 and 178, the respective electrode wires 86 and 88 extend in a direction substantially parallel to the longitudinal axis of the donor roll. An alternating electrical bias is applied to the electrode wires by an AC voltage source 190. The applied AC establishes an alternating electrostatic field between each pair of wires and the respective donor roll, which is effective in detaching toner from the surface of the donor roll and forming a toner cloud about the wires, the height of the cloud being such as not to be substantially in contact with image bearing surface 10. The magnitude of the AC voltage is in the order of 200 to 500 volts peak at frequency ranging from about 8 kHz to about 16 kHz. A DC bias supply (not shown) applied to each donor roll 176 and 178 establishes electrostatic fields between the image bearing surface 10 and donor rolls for attracting the detached toner particles from the clouds surrounding the wires to the latent image recorded on the photoconductive surface of the image bearing surface.

After development, excess toner may be stripped from donor rolls 176 and 178 by respective cleaning blades (not shown) so that magnetic brush roll 170 meters fresh toner to the clean donor rolls. As successive electrostatic latent images are developed, the toner particles within the developer material 166 are depleted. A developer dispenser 105 stores a supply of toner particles, with or without carrier particles. The dispenser 105 is in communication with reservoir 164 and, as the concentration of toner particles in the developer material is decreased (or as carrier particles are removed from the reservoir as in a "trickle-through" system or in a material purge operation as discussed below), fresh material (toner and/or carrier) is furnished to the developer material 166 in the reservoir. The auger 168 in the reservoir chamber mixes the fresh material with the remaining developer material so that the resultant developer material therein is substantially uniform with the concentration of toner particles being optimized. In this way, a substantially constant amount of toner particles is in the reservoir with the toner particles having a constant charge. The developer housing or reservoir 164 may also include an outlet 195 for removing developer material from the housing in accordance with a developer material purge operation as discussed in detail below. The outlet 195 may farther include a regulator (not shown) such as an auger or roller to assist in removing material from the housing.

In one embodiment, various sensors and components within the toner development system 100 are in communication with a system controller 90, which monitors and controls the operation of the developer apparatus to maintain the apparatus in an optimal state. In addition to the voltage source 190, the donor rolls 176 and 178, the magnetic brush roll 170, the augers 168, the dispenser 105 and the outlet 195, the system controller 90 may, for example, communicate with a variety of sensors, including, for example, sensors to measure toner concentration, toner charge, toner humidity, bias of the magnetic brush roll, and the bias of the donor roll.

When each donor roll 176 or 178 rotates and completes a full rotation, the donor roll 176 or 178 has toner with a different charge/mass ratio than in regions where the toner has been on the roll for multiple revolutions. In particular, the developability may be less for toner in regions of the roll where toner was removed during the previous revolution. This leads to the possibility of a reload error or reload defect, which appears as a light area in the later region. The noise mid-frequency (mottle) is caused by an incomplete transfer of toner to the image bearing surface 10. As noted above, the present disclosure is not limited to reload or noise mid-frequency (mottle) and can be extended to any two-dimensional image quality non-uniformities (e.g., graininess).

Figure 2:
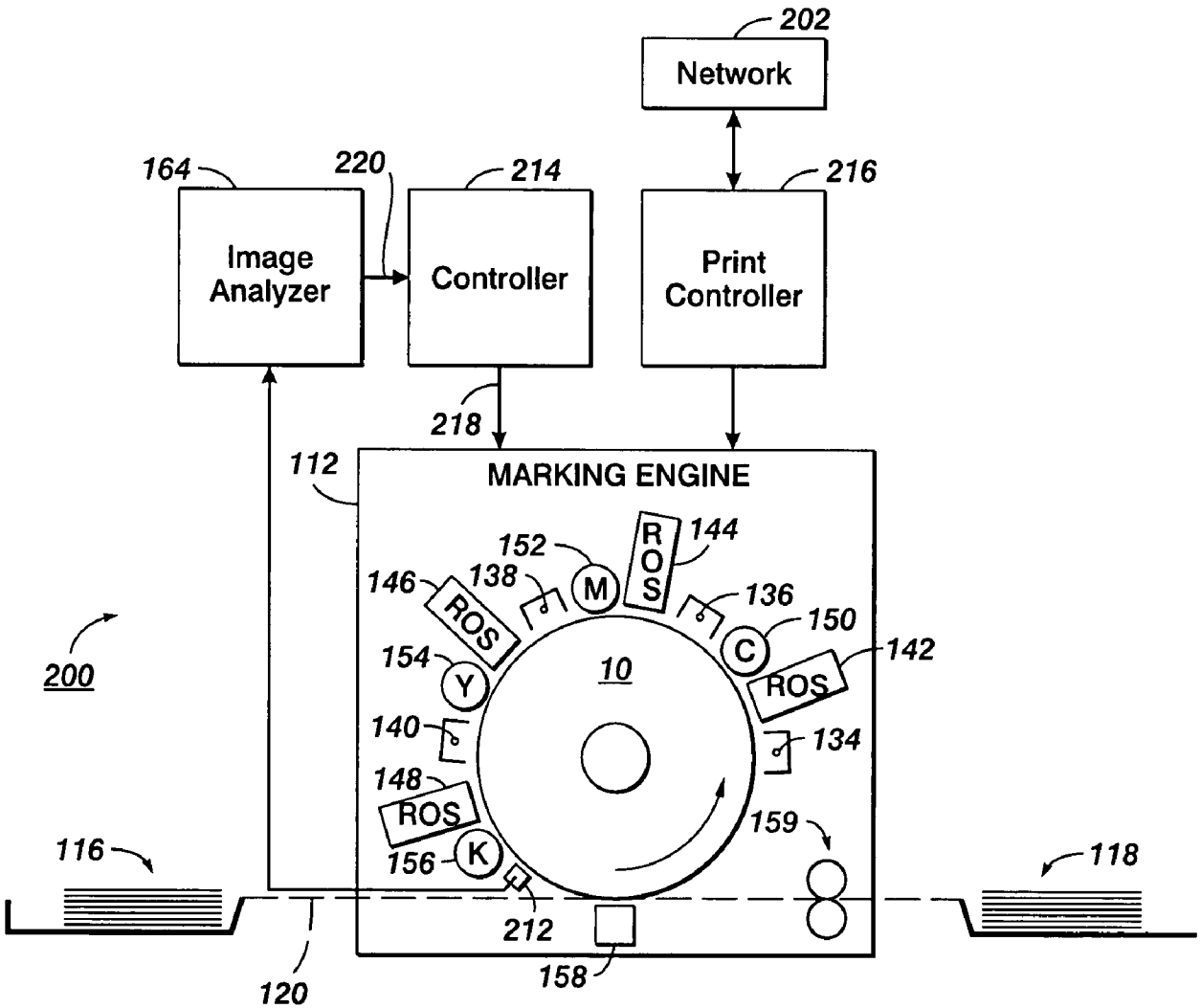
FIG. 2 shows a schematic view of an image printing system in accordance with an embodiment of the present disclosure.

FIG. 2 illustrates a simplified elevation view of basic elements of a color printer, showing a context of the present disclosure. Specifically, there is shown an "image-on-image" xerographic color printer, in which successive primary-color images are accumulated on the image bearing surface 10, and the accumulated superimposed images are in one step directly transferred to an output media as a full-color image. In one implementation, the Xerox® iGen3™ digital printing press may be utilized. However, it is appreciated that any printing machine, such as monochrome machines using any technology, machines that print on photosensitive substrates, xerographic machines with multiple photoreceptors, or ink-jet-based machines, can beneficially utilize the present disclosure as well.

The image printing system 200 is configured to minimize two-dimensional image quality non-uniformities on printed documents. The image printing system 200 includes a marking engine 112, a linear array sensor 212, an image analyzer 164, and a controller 214. The marking engine 112 is constructed to print toner images on the image bearing surface 10 moving in a process direction. The linear array sensor 212 is adjacent the image bearing surface 10 and is extending in a cross-process direction. The linear array sensor 212 is configured to scan the toner image on the image bearing surface 10. The image analyzer 164 is configured to detect a two-dimensional non-uniformity in the toner image. The controller 214 is configured to control at least one control parameter of a toner development system 100 (as shown in FIG. 1) based on the two-dimensional image quality non-uniformity in the toner image that is detected by the image analyzer 164.

The image printing system 200 generally has two important dimensions: the process (or slow scan) direction and the cross-process (or fast scan) direction. The direction in which the image bearing surface 10 moves is referred to as process (or slow scan) direction, and the direction that is transverse or perpendicular to the process direction (e.g., in which the plurality of sensors are oriented) is referred to as cross-process (or fast scan) direction.

In one embodiment, the image printing system 200 includes a print controller 216. In one embodiment, the print controller 216 is used to manage print devices especially in high-volume environments, e.g., color laser printers, production printers and digital presses. In one embodiment, the print controller 216 is a Digital Front End (DFE). Image content in the digital forms (i.e., a data file) is accepted, stored, produced, decomposed or otherwise presented at the print controller 216. The print controller 216 accepts content for images desired to be printed in any one of a number of possible formats, such as, for example, TIFF, JPEG, or Adobe® PostScript™. This image content is then "interpreted" or "decomposed" in a known manner into a format usable by a marking engine controller. The print controller 216 increases the productivity by efficiently automating digital workflow. Typically, the print controller 216 is an external device, such as computer or server that interfaces to a network 202 and typically accepts image content and process the image content for a copier or printer devices. However, the print controller 216 could be a part of the printing device itself. For example, the Xerox® iGen3™ digital printing press incorporates a print controller. By having the knowledge of each pixel individually, the print controller 216 can process each pixel of the image content more intelligently.

The image printing system 200 includes one or more marking engines 112 (only one marking engine is shown in FIG. 2), where the marking engine 112 is constructed to print toner images on the image bearing surface 10 moving in the process direction. The illustrated marking engine 112 employs xerographic printing technology, in which an electrostatic image is formed and coated with a toner material, and then transferred and fused to paper or another print media by application of heat and pressure. However, marking engines employing other printing technologies can be provided, such as marking engines employing aqueous ink jet printing, solid ink jet printing thermal impact printing, and the like. In one embodiment, a print media source 116, such as a paper tray, is configured to supply paper or other print media to the marking engine 112 for printing. In one embodiment, a finisher 118, such as a paper tray, is configured to receive the print media from the marking engine 112 and may provide finishing capabilities such as collation, stapling, folding, stacking, hole-punching, binding, postage stamping, and the like. In one embodiment, a conveyor system 120 conveys the print media between the source 116 and the marking engine 112 and between the marking engine 112 and the finisher 118.

In one embodiment, the image bearing surface 10 of the image printing system 200 is selected from the group consisting of a photoreceptor drum, a photoreceptor belt, an intermediate transfer belt, and an intermediate transfer drum. That is, the term image bearing surface means any surface on which a toner image is received, and this may be an intermediate surface (i.e., a drum or belt on which a toner image is formed prior to transfer to the printed document). For example, a "tandem" xerographic color printing systems (e.g., U.S. Pat. Nos. 5,278,589; 5,365,074; 6,904,255 and 7,177,585, each of which are incorporated by reference), typically include plural print engines transferring respective colors sequentially to an intermediate image transfer surface (e.g., belt or drum) and then to the final substrate.

Disposed along the image bearing surface 10 are a series of xerographic subsystems, which include, for each of the colors to be applied (one in the case of a monochrome printing system, four in the case of a CMYK printing system), a charging station 134, 136, 138, 140 such as a charging corotron, an exposure station 142 144, 146, 148, which forms a latent image on the image bearing surface 10, such as a Raster Output Scanner (ROS), and a developer unit 150, 152, 154, 156, associated with each charging station, for developing the latent image formed on the image bearing surface 10 by applying toner to obtain a toner image. The successive color separations are built up in a superimposed manner on the surface of image bearing surface 10, and then the combined full-color toner image is transferred at the transfer unit 158 (e.g., transfer corotron) to an output media. A fuser 159 fuses the image to the media. The fuser generally applies at least one of heat and pressure to the media to physically attach the toner and optionally to provide a level of gloss to the printed media. In any particular embodiment of an electrophotographic marking engine, there may be variations on this general outline, such as additional corotrons, cleaning devices, and the like.

Therefore, it will be appreciated that the marking engine is not limited to the specific arrangement of subsystems illustrated. For example, in another exemplary marking engine (not shown), each colorant is associated with its own photoreceptor and the image transferred between the photoreceptor and the print media by an intermediate transfer belt. In yet another embodiment, a single ROS and a single charging station are used and the print media is returned to the transfer point 158 multiple times.

In one embodiment, the toner image is in the form of a test patch or a test pattern located on the image bearing surface 10. In one embodiment, a customized test pattern, which can be a series of evenly spaced patches, may be used to monitor a property of the toner image using the sensor. In one embodiment, the test pattern contemplated may take a variety of forms but preferably takes the form of a recognizable bar code or sequence of colors in a convenient arrangement. In one embodiment, the image printing system 200 may include a test patch module that is capable of generating a test patch and sending it to the marking engine 112 for printing. In one embodiment, the toner image may be a test image of uniform gray level over the entire image for a given color separation. When the test patch is printed, any image quality non-uniformities show up in the image as variations in the reflectance (i.e., gray level), for example, a higher or lower reflectance than the surrounding area.

As noted above, the linear array sensor 212 is adjacent the image bearing surface 10 and is extending in a cross-process direction. The linear array sensor 212 is configured to sense reflectance from the toner images on the image bearing surface 10 (e.g., that can be correlated with gray levels) from which the two-dimensional image quality non-uniformity (e.g., noise mid-frequency defect (mottle), reload, graininess), where present, can be detected. In illustrated embodiment, the linear array sensor 212 may be placed just before a transferring unit (e.g., a transfer corotron 158) where the toner is transferred to the print media.

Preferably, the linear array sensor 212 is, for example, a fall width array (FWA) sensor. A full width array sensor is defined as a sensor that extends substantially an entire width (perpendicular to a direction of motion) of the moving image bearing surface 10. The full width array sensor is configured to detect any desired part of the printed image, while printing real images. The full width array sensor may include a plurality of sensors equally spaced at intervals (e.g., every 1/600 th inch (600 spots per inch)) in the cross-process (or a fast scan) direction. See for example, U.S. Pat. No. 6,975,949, incorporated herein by reference. It is understood that other linear array sensors may also be used, such as contact image sensors, CMOS array sensors or CCD array sensors. Although the full width array (FWA) sensor or contact sensor is shown in the illustrated embodiment, it is contemplated that the present disclosure may use sensor chips that are significantly smaller than the width of the image bearing surface, through the use of reductive optics. In one embodiment, the sensor chips may be in the form of an array that is one or two inches long and that manages to detect the entire area across the image bearing surface through reductive optics. In one embodiment, the linear array sensor 212 may be any suitable sensor capable of detecting variations in reflectance across an image, such as a spectrophotometer. In one embodiment, a processor is provided to both calibrate the linear array sensor and to process the reflectance data detected by the linear array sensor. It could be dedicated hardware like ASICs or FPGAs, software, or a combination of dedicated hardware and software.

The image analyzer 164 is configured for detecting two-dimensional image quality non-uniformities in the toner image on the image bearing surface 10. The image analyzer 164 receives the image content from the sensor 212, analyses the detected reflectances and detects the two-dimensional non-uniformities in the toner image. In one embodiment, the image analyzer 164 may be an individual processor or multiple processors with the different functions (i.e., receiving the image content from the linear array sensor, processing the detected reflectances, and detecting the two-dimensional non-uniformities in the toner image) distributed among them.

In one embodiment, the image analyzer 164 is configured for detecting mottle image quality non-uniformity. "A Comparisons of Different Print Mottle Evaluation Models" by Carl-Magnus Fahlcrantz and Per-Ake Johansson, herein incorporated by reference, provides examples of different approaches that are used to evaluate the mottle image quality non-uniformity. In one embodiment, the image analyzer 164 is configured to use any of these different approaches as discussed in the above article to evaluate the mottle image quality non-uniformity. For example, as discussed in the above article, mottle or noise-mid frequency is characterized as aperiodic fluctuations of density at a spatial frequency less than 0.4 cycles per millimeter in all directions. The measure of mottle across the Region of Interest (ROI) is the standard deviation of the $m_i$, where $m_i$ is the average of density measurements within cell i, as discussed in the above article, is calculated using the formula:

$$\text{Mottle} = \sqrt{\frac{1}{n-1}\sum_{i=1}^{n}\left(m_i - \left(\frac{1}{n}\sum_{i=1}^{n} m_i\right)\right)^2}$$

Similarly, as discussed in the above article, graininess is characterized as aperiodic fluctuations of density at a spatial frequency greater than 0.4 cycles per millimeter in all directions. The measure of graininess across the Region of Interest (ROI), as discussed in the above article, is calculated using the formula:

$$\text{Graininess} = \sqrt{\sum_{i=1}^{n}\frac{\sigma_i^2}{n}}$$

where $\sigma_i$ is the standard deviation of optical density measurements within cells i, and n is the total number of cells.

In one embodiment, Region of Interest (ROI), as described in the above article, is a region of at least 161 $mm^2$ with smallest dimension at least 12.7 mm, container wholly in the area. The ROI should be divided into at least 100 uniform, non-overlapping square cells or tiles with area at least 1.61 $mm^2$ and smallest dimension at least 1.27 mm. Within each tile or cell, 900 evenly-spaced, non-overlapping measurements of density are made. For each tile or cell i, $m_i$ is the average of these measurements; $\sigma_i$ is the standard deviation of the measurements.

"Evaluating Colour Print Mottle" by Carl-Magnus Fahlcrantz and Kristoffer Sokolowski, STFI-Packforsk, herein incorporated by reference, provides example of another approach that is used to evaluate the mottle image quality non-uniformity.

Figure 8:
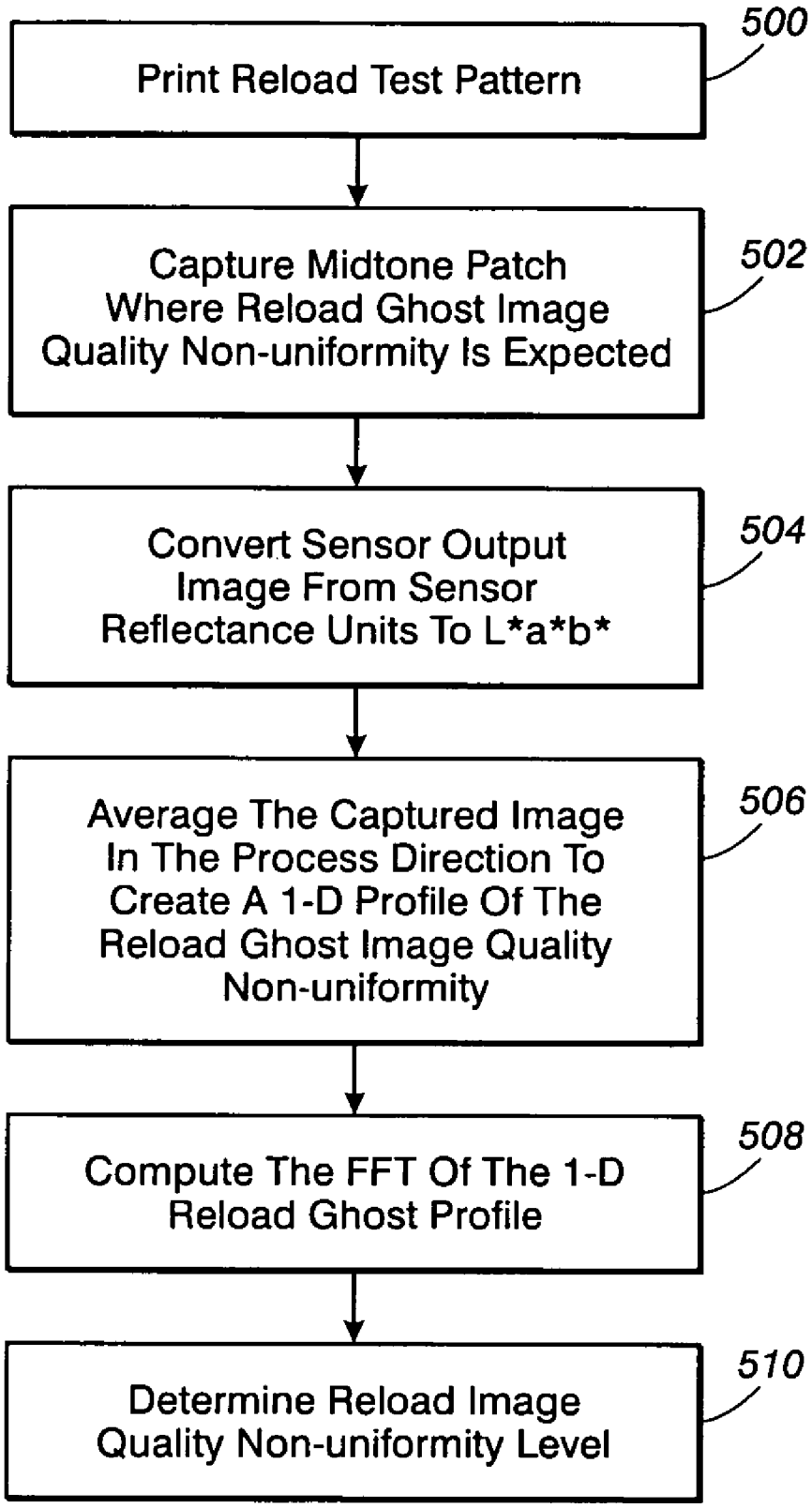
FIG. 8 shows a schematic illustration of a method for reload analysis in accordance with an embodiment of the present disclosure.
Figure 9A:
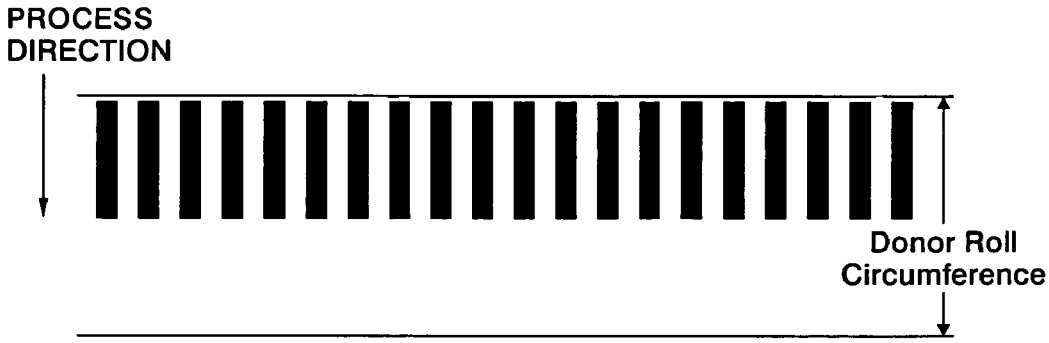
FIG. 9A shows an exemplary reload test pattern in accordance with an embodiment of the present disclosure.
Figure 9B:
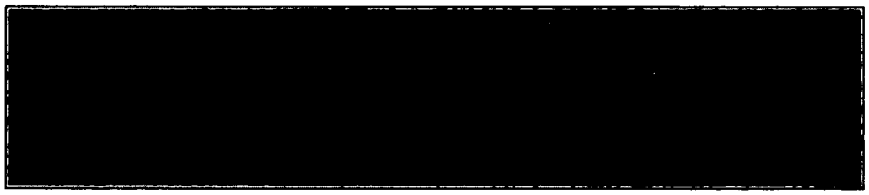
FIG. 9B shows an exemplary midtone patch with reload ghost image quality non-uniformity in accordance with an embodiment of the present disclosure.
Figure 9C:
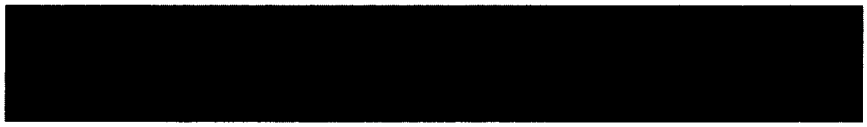
FIG. 9C shows an exemplary captured image with reload ghost image quality non-uniformity in accordance with an embodiment of the present disclosure.
Figure 9D:
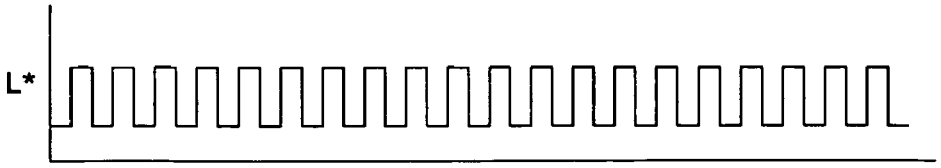
FIG. 9D shows an exemplary 1-D profile of reload ghost image quality non-uniformity in accordance with an embodiment of the present disclosure.

In one embodiment, the image analyzer 164 is configured for detecting reload image quality non-uniformity. FIG. 8 shows a method of reload analysis in accordance with an embodiment of the present disclosure. The method begins at procedure 500 in which a reload test pattern in printed. FIG. 9A shows an exemplary reload test pattern that includes periodic stripes. In one embodiment, the reload test pattern is printed following a midtone patch. FIG. 9B shows an exemplary midtone patch with reload ghost image quality non-uniformity. The method then proceeds to procedure 502 in which a midtone patch that includes a reload ghost image quality non-uniformity is captured. FIG. 9C shows an exemplary captured image with the reload ghost image quality non-uniformity. In one embodiment, the midtone patch is captured where the reload ghost image quality non-uniformity is expected. In one embodiment, the midtone patch is captured using the in situ full width array sensor 212. The method then may proceed to procedure 504 in which the sensor output images are converted from a raw sensor reflectance units to a L*a*b* units. In one embodiment, a L*a*b* color space is a color space where dimension L is for lightness, and a and b are for color-opponent dimensions. The method then may proceed to procedure 506 in which the captured image is averaged along the process direction to create a 1-D profile of the reload ghost image quality non-uniformity. FIG. 9D shows an exemplary 1-D profile of the reload ghost image quality non-uniformity. The method then may proceed to procedure 508 in which a Fast Fourier Transform (FFT) of the 1-D reload ghost image quality non-uniformity profile is computed. The method then may proceed to procedure 510 in which a reload image quality non-uniformity level is determined. The reload image quality non-uniformity level is equal to the amplitude of the Fast Fourier Transform (FFT) curve at a spatial frequency by a test target or a test pattern. In one embodiment, the test target or the test pattern frequencies in general may range from 0.1-0.5 cycles/mm.

As noted above, the controller 214 is configured to control at least one control parameter of the toner development system 100 (as shown in FIG. 1) based on the two-dimensional image quality non-uniformity in the toner image that is detected by the image analyzer 164. The controller 214 communicates with the marking engine 112 or directly with actuators for the xerographic subsystems 132, 134, 136, 138, 140, 142, 144, 146, 148, 150, 152, 154, 156, 158, 159 thereof for controlling the xerographic subsystems. While the controller 214 is illustrated as a single unit, it is to be appreciated that the controller may be distributed throughout the image printing system 200, for example, located in the marking engine(s) or xerographic subsystems or elsewhere, such as in the workstations. In one embodiment, the controller 214 may be embodied in a CPU or other processing device with associated memory for storing processing instructions.

In one embodiment, the image printing system 200 may include other processing components. The processing components may be in the form of modules performing the functions of the image printing system 200, although it is to be appreciated that two or more of the modules may be combined. The modules may include, but not limited to, a raster image processing (RIP) module for converting an input image into a form in which it can be rendered, and a test patch module for controlling the generation of a test patch, all of which can be interconnected by a data/control bus. The image printing system 200 may include other components known in printing systems, such as a scheduling component for scheduling the order of printing of multiple jobs.

If a two-dimensional non-uniformity is detected by the image analyzer 164, the controller 214 is configured to send commands 218 to the actuators within the toner development system 100 (as shown in FIG. 1) of the marking engine to control or modulate the actuators within the toner development system 100 to mitigate or minimize the two-dimensional image quality non-uniformities. Thus, the controller 214 can adjust the subsequent operation of the marking engine 112 in a closed-loop fashion based on an output 220 from the image analyzer 164. For example, the actuators within the toner developer system 100 are adjusted to effect two-dimensional image quality non-uniformities, such as mottle and, reload, based on the output 220 from the image analyzer 164. The control parameters within the toner development system that are adjusted to minimize or mitigate the two-dimensional image quality non-uniformities may include, but not limited to, the following: toner concentration, toner charge to mass ratio, magnetic roll speed, donor to magnetic roll AC voltage, donor to magnetic roll DC voltage, and magnetic roll bias.

With the knowledge of the detected two-dimensional image quality non-uniformities from the image analyzer 164, the control actuators which operate to mitigate or minimize these detected two-dimensional image quality non-uniformities may be advantageously controlled by the controller 214.

Figure 3:
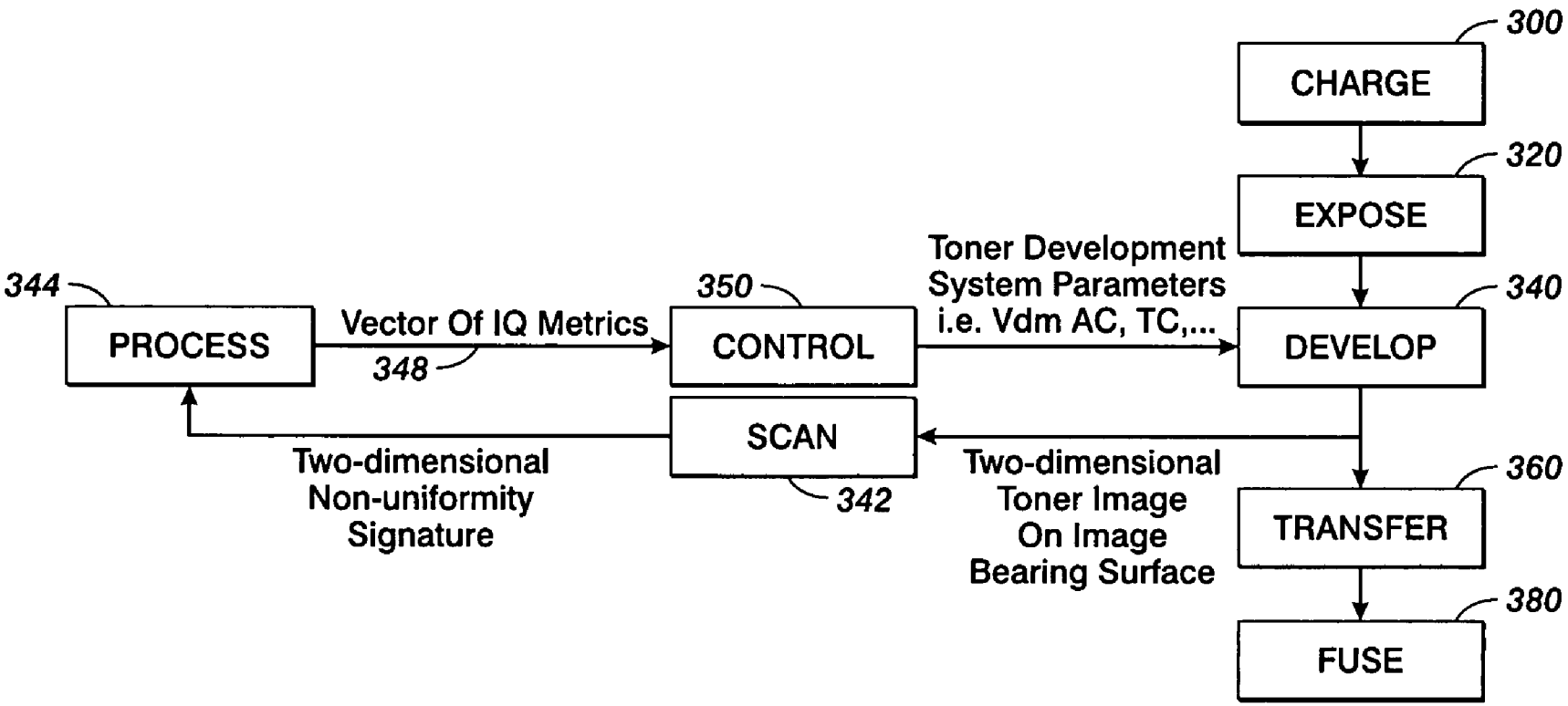
FIG. 3 shows an exemplary schematic of a two-dimensional image quality non-uniformity analysis system for the image printing system in accordance with an embodiment of the present disclosure.

In the exemplary feedback control scheme of FIG. 3, the feedback of two-dimensional non-uniformity (e.g., in the toner image on the image bearing surface) from the linear array sensor 212 is analyzed using signal and/or image processing algorithms to produce a reduced set of image quality (IQ) metrics. These may include, as non-limiting examples, mottle, graininess, reload, etc. These metrics of particular two-dimensional image quality non-uniformities then enable the controller 214 to make adjustments to appropriate actuators of the toner development system 100 to mitigate the specific two-dimensional image quality non-uniformities.

An image (e.g., customer image) is input into the image printing system 200, such as, for example, through scanning. The input image is output to the marking engine for printing of an output print. This input image is used by various "upstream" print engine stations, including a charging station, an exposure station and a development station. At the procedure 300, the charging station charges the image bearing surface 10. At the procedure 320, the exposure station (e.g., a Raster Output Scanner (ROS)) exposes the charged image area to a laser beam output. The laser beam output discharges some parts of the image area so as to create an electrostatic latent representation of the exposing beam. Thus, after the exposure, the image area has a voltage profile comprised of relatively high voltages and of relatively low voltages. The relatively high voltages exist on those parts of the image area which were not illuminated while the relatively low voltages exist on those parts which were illuminated. After passing through the exposure station, at procedure 340, the exposed image area passes the development station which deposits negatively charged toner onto the image area. The latent electrostatic images are developed by a developer at procedure 340. Thus, the charging station, the exposure station and the development station together develop a toner image on the image bearing surface 10 that is advanced to a transfer station and a fusing station. At procedure 360, the developed image is transferred to a print media. At procedure 380, following transfer, the media bearing the transferred image is advanced to the fusing station where a fuser assembly permanently affixes or fuses the toner powder image to the media.

Between the procedures 340 and 360 (i.e., after the toner image is developed on the image bearing surface 10 but before the toner image is transferred to the media), the linear array sensor 212 (e.g., a two-dimensional mass sensor), at procedure 342, scans the toner image on the image bearing surface 10. At procedure 344, the image analyzer 164 receives the two-dimensional non-uniformity signature from the linear array sensor 212, detects particular types of two-dimensional non-uniformities in the image, and outputs various image quality defect metrics 348 to the controller 214. In one embodiment, the image analyzer 164 optionally quantifies the level of any detected non-uniformities. The image analyzer 164 can then output a reduced vector of image quality metrics 348, which in turn is input to the controller 214. At procedure 350, the controller 214 can then adjust subsequent operation of the toner development system in a closed-loop fashion based on the metrics 348 to compensate for detected image quality non-uniformities. In one embodiment, the controller 214 controls the actuators that control the toner development system.

The control loop enabled by this two-dimensional sensing is the ability to measure particular non-uniformity in the toner image on the image bearing surface, thereby allowing for corrective actions to be taken that are specific to the individual non-uniformities that were detected (as well as the magnitudes of the non-uniformities).

Figure 4:
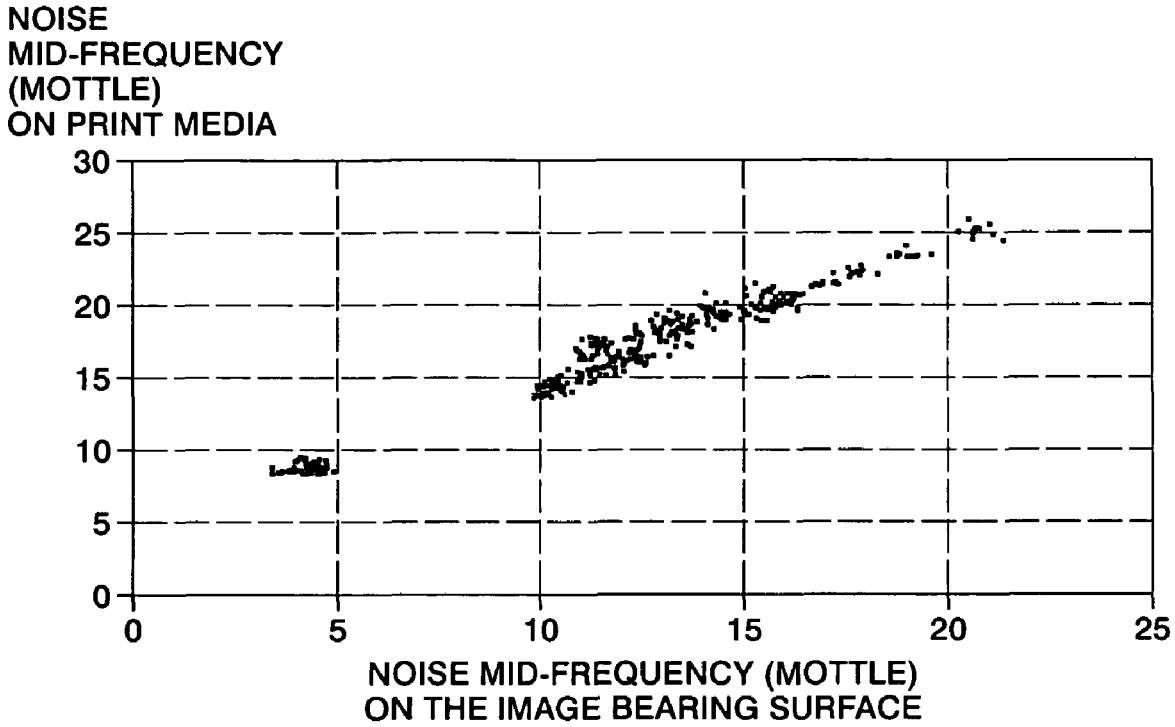
FIG. 4 shows a graph showing the relationship between the noise mid-frequency (mottle) on the image bearing surface measured using a linear sensor array and the noise mid-frequency (mottle) measured directly off the output prints using standard image analysis.
Figure 5:
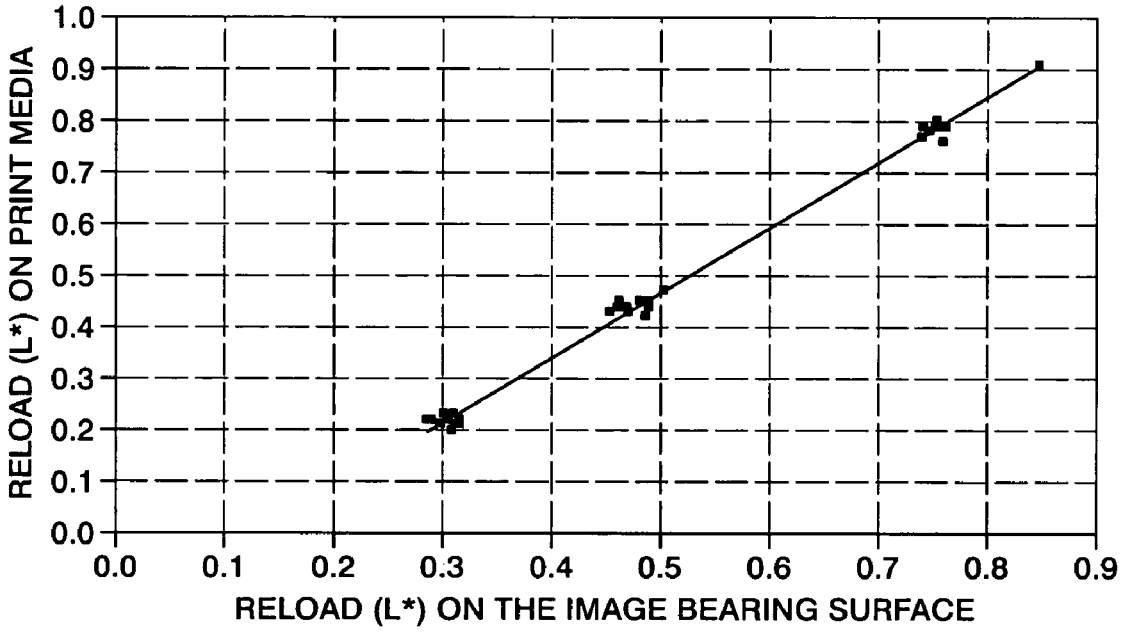
FIG. 5 shows a graph showing the relationship between the reload on the image bearing surface measured using the linear sensor array and the reload measured directly off the output prints using standard image analysis.

The graphs of FIGS. 4 and 5 correlate the linear array sensor detection of mottle and reload with that measured directly off of the output prints using standard image analysis tools.

In the graph of FIG. 4, the X-axis represents the noise-mid frequency (mottle) detected in the toner image on the image bearing surface using the linear array sensor and the Y-axis represents the noise-mid frequency (mottle) that measured directly off of the output prints using standard image analysis tools. Similarly, in the graph of FIG. 5, the X-axis represents the reload detected in the toner image on the image bearing surface using the linear array sensor and the Y-axis represents the reload that measured directly off of the output prints using standard image analysis tools.

For X-axis values, individual two-dimensional non-uniformity signatures in the toner image on the image bearing surface 10 were then examined by the linear array sensor and, through suitable post-processing of the resultant two-dimensional non-uniformity signatures, the levels of each two-dimensional non-uniformities were quantified.

For Y-axis values, the output prints printed by the print engine were then analyzed using known conventional image quality analysis software to quantify the levels of mottle and reload present on the output media. As can be seen, the image quality metrics calculated directly from the two-dimensional non-uniformity signatures detected by the two-dimensional mass sensor from the toner image on the image bearing surface strongly correlates with the results obtained from analysis of the output print images. Thus, it can be established from the graphs of FIGS. 4 and 5 that a reasonable correlation exists between the two-dimensional non-uniformities detected (e.g., mottle and reload) by the linear array sensor and that measured directly off of the output prints using standard image analysis tools.

Figure 6:
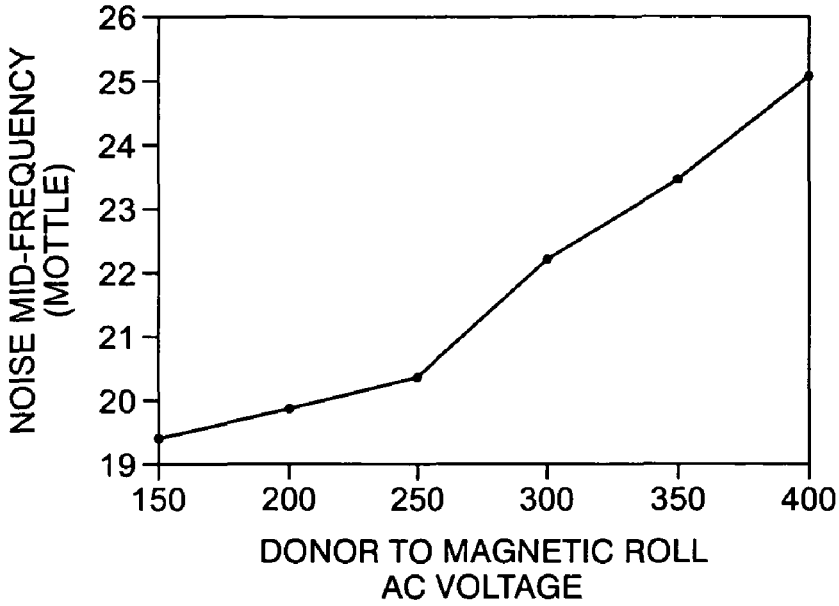
FIG. 6 shows a graph showing the effect of varying the donor to magnetic roll AC voltage on noise mid-frequency (mottle)
Figure 7:
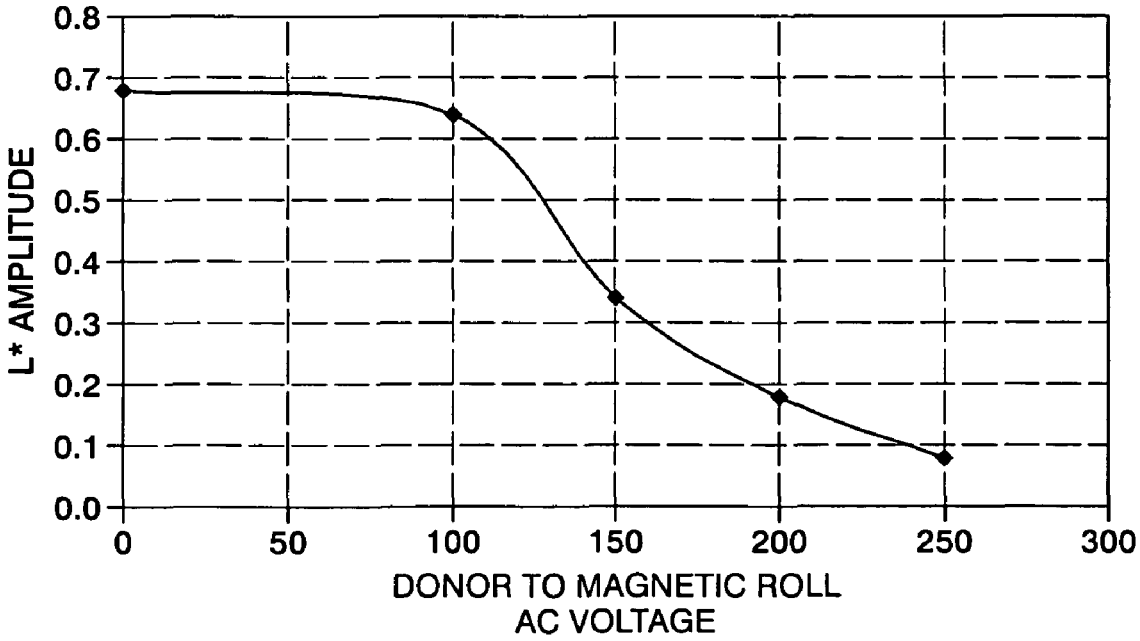
FIG. 7 shows a graph showing the effect of varying the donor to magnetic roll AC voltage on reload.

The graphs of FIGS. 6 and 7 show the effect of varying the donor to magnetic roll AC voltage (Vdm) on the two-dimensional image quality non-uniformities. The donor to magnetic roll potential "Vdm" causes a current "i" to flow in the donor and magnetic roll nip. The magnitude of this current is directly proportional to the conductivity of the developer and Vdm.

The graph of FIG. 6 shows the effect of varying the donor to magnetic roll AC voltage on noise mid-frequency (mottle). The X-axis represents the donor to magnetic roll AC voltage measured in volts and the Y-axis represents the noise-mid frequency (mottle) measured in two-dimensional image smoothness.

The graph of FIG. 7 shows the effect of varying the donor to magnetic roll AC voltage on reload. The X-axis represents the donor to magnetic roll AC voltage measure in volts and the Y-axis represents the reload measured in L*amplitude.

In one embodiment, an image printing system may include any device for rendering an image on print media, such as a copier, laser printer, bookmaking machine, facsimile machine, or a multifunction machine. In one embodiment, an image generally may include information in electronic form which is to be rendered on the print media by the printing system and may include text, graphics, pictures, and the like.

In one embodiment, the operation of applying images to print media, for example, graphics, text, photographs, etc., is generally referred to herein as printing or marking. In one embodiment, a print media can be a usually flimsy physical sheet of paper, plastic, or other suitable physical print media substrate for images.

While the present disclosure has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the present disclosure following, in general, the principles of the present disclosure and including such departures from the present disclosure as come within known or customary practice in the art to which the present disclosure pertains, and as may be applied to the essential features hereinbefore set forth and followed in the spirit and scope of the appended claims.

What is claimed is:

1. An image printing system configured to minimize two-dimensional image quality non-uniformities on printed documents, the system comprising:

a marking engine constructed to print toner images on an image bearing surface moving in a process direction, wherein the marking engine comprises a toner development system and the toner image comprises an image dependent reload ghost non-uniformity;

a linear array sensor adjacent to the image bearing surface and extending in a cross-process direction, the linear array sensor being configured to scan the toner image on the image bearing surface to obtain image data;

an image analyzer configured to:

a) average the image data along the process direction to obtain an image dependent reload ghost non-uniformity profile; and b) detect the image dependent reload ghost non-uniformity from the image dependent reload ghost non-uniformity profile; and a controller configured to control at least one control parameter of at least one actuator of the toner development system based on the image dependent reload ghost non-uniformity that is detected by the image analyzer so as to compensate for the detected image dependent reload ghost non-uniformity, wherein the at least one control parameter is selected from the group consisting of toner concentration, toner charge to mass ratio, magnetic roll speed, donor to magnetic roll AC voltage, donor to magnetic roll DC voltage, and magnetic roll bias.

2. The system of claim 1, wherein the linear array sensor is a full width array (FWA) sensor.

3. The system of claim 1, wherein the image bearing surface is selected from the group consisting of a photoreceptor drum, a photoreceptor belt, an intermediate transfer belt, and an intermediate transfer drum.

4. A method for minimizing two-dimensional image quality non-uniformities on printed documents, the method comprising:

printing toner images on an image bearing surface moving in a process direction, wherein the toner image comprises an image dependent reload ghost non-uniformity;

scanning the toner image on the image bearing surface using a linear array sensor to obtain image data, wherein the linear array sensor is extending in a cross-process direction and is adjacent the image bearing surface;

averaging the image data along the process direction to obtain an image dependent reload ghost non-uniformity profile;

detecting, using an image analyzer, the image dependent reload ghost non-uniformity from the image dependent reload ghost non-uniformity profile; and controlling at least one control parameter of at least one actuator of a toner development system based on the image dependent reload ghost non-uniformity that is detected by the image analyzer so as to compensate for the detected image dependent reload ghost non-uniformity, wherein the at least one control parameter is selected from the group consisting of toner concentration, toner charge to mass ratio, magnetic roll speed, donor to magnetic roll AC voltage, donor to magnetic roll DC voltage, and magnetic roll bias.

5. The method of claim 4, wherein the linear array sensor is a full width array (FWA) sensor.

6. The method of claim 4, wherein the image bearing surface is selected from the group consisting of a photoreceptor drum, a photoreceptor belt, an intermediate transfer belt, and an intermediate transfer drum.

7. The method of claim 4, wherein the image dependent reload ghost non-uniformity profile is determined in the process direction, characterized by an image dependent reload ghost image quality test pattern.

8. A method for minimizing image dependent reload ghost non-uniformities on printed documents, the method comprising:

scanning, using a linear array sensor, a toner image on an image bearing surface to obtain image data, wherein the linear array sensor is extending in a cross-process direction and is adjacent the image bearing surface, wherein the image bearing surface is moving in a process direction and wherein the toner image comprises an image dependent reload ghost non-uniformity;

averaging the image data along the process direction to obtain an image dependent reload ghost non-uniformity profile;

detecting, using an image analyzer, an image dependent reload ghost non-uniformity level from the image dependent reload ghost non-uniformity profile; and controlling at least one control parameter of at least one actuator of a toner development system based on the image dependent reload ghost non-uniformity level that is detected by the image analyzer so as to compensate for the detected image dependent reload ghost non-uniformity, wherein the at least one control parameter is selected from the group consisting of toner concentration, toner charge to mass ratio, magnetic roll speed, donor to magnetic roll AC voltage, donor to magnetic roll DC voltage, and magnetic roll bias.

9. The method of claim 8, wherein the image dependent reload ghost non-uniformity profile is obtained by printing the toner image on the image bearing surface following a midtone toner image.

10. The method of claim 8, wherein the image dependent reload ghost non-uniformity profile is determined in the process direction that is characterized by an image dependent reload ghost image quality test pattern.

* * * * *